US005752331A

United States Patent [19]

Perrissoud et al.

[11] Patent Number: 5,752,331

[45] Date of Patent: May 19, 1998

[54] SHOE WITH CONTROLLED FLEXIBILITY

[75] Inventors: Claude Perrissoud, Saint-Jorioz; René Borel, Cran-Gevrier, both of France

[73] Assignee: Salomon S.A., Metz-Tessy, France

[21] Appl. No.: 597,604

[22] Filed: Feb. 6, 1996

[30] Foreign Application Priority Data

Feb. 10, 1995 [FR] France ..... 95 01699

[51] Int. Cl.[6] ..... A43B 5/04

[52] U.S. Cl. ..... 36/118.3; 36/117.1; 36/118.2

[58] Field of Search ..... 36/118.2, 118.3, 36/118.5, 118.8, 118.9, 119.1

[56] References Cited

U.S. PATENT DOCUMENTS 4,665,635 5/1987 Benoit et al. ..... 36/118.2
5,088,211 2/1992 Walkhoff ..... 36/118.2
5,441,296 8/1995 Phelipon et al. ..... 280/602
5,465,994 11/1995 Commier et al. ..... 280/602

FOREIGN PATENT DOCUMENTS 56774 7/1982 European Pat. Off. ..... 36/118.3

*Primary Examiner*—Paul T. Sewell
*Assistant Examiner*—Anthony Stashick
*Attorney, Agent, or Firm*—Greenblum & Bernstein P.L.C.

[57] ABSTRACT

The invention relates a sport shoe having a shell base topped by an upper that is pivotal/flexible with respect to the shell base via a flexion control arrangement. The flexion control arrangement includes a viscous element interposed between mobile portions which overlap and displace relatively with respect to each other when the upper pivots, forming a flexion control by viscous friction. The viscous element procures a silent and constant braking between the mobile portions.

19 Claims, 5 Drawing Sheets

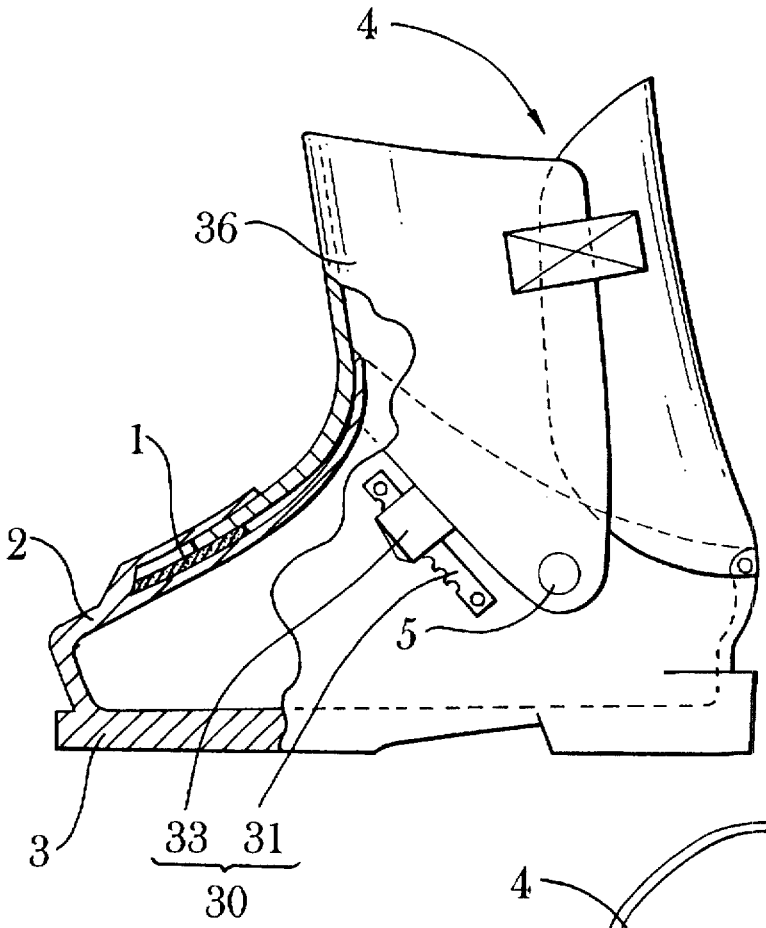
Fig. 3
Fig. 4
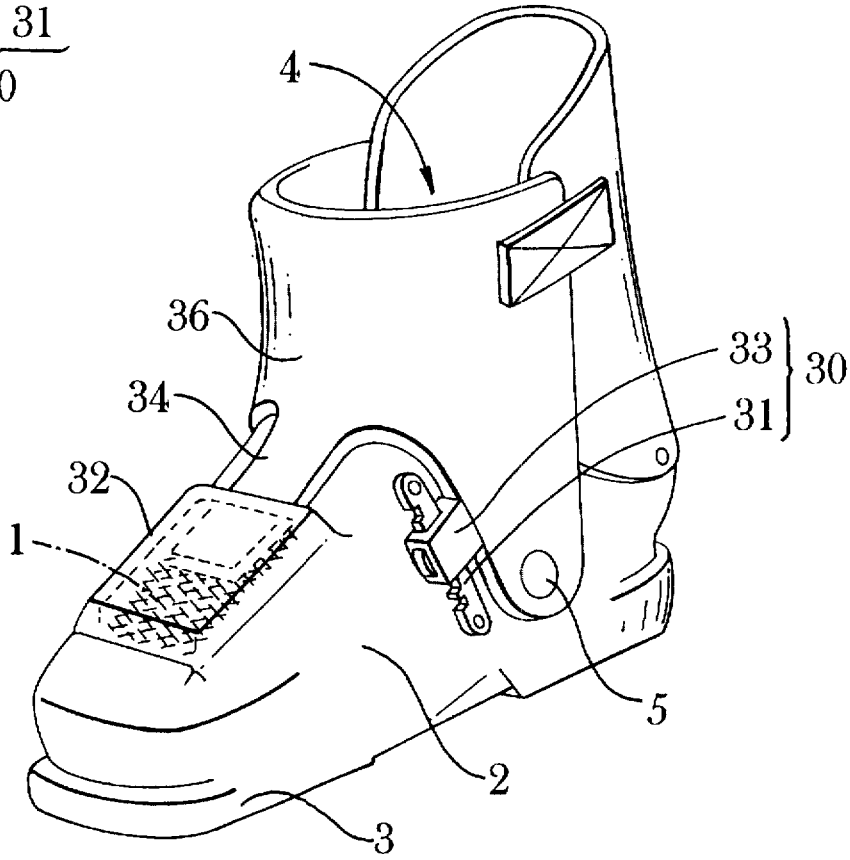

Fig. 5
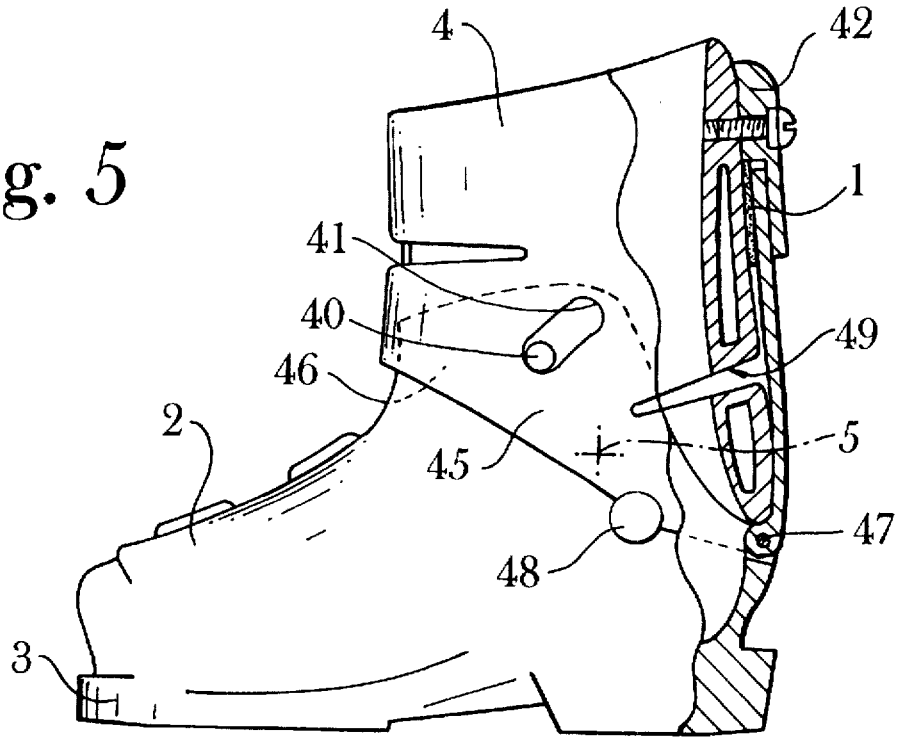
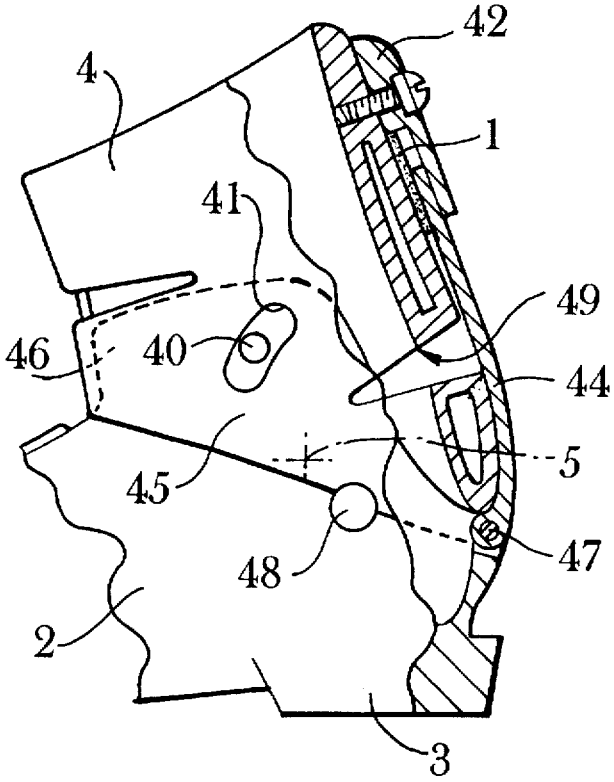
Fig. 6
Fig. 7
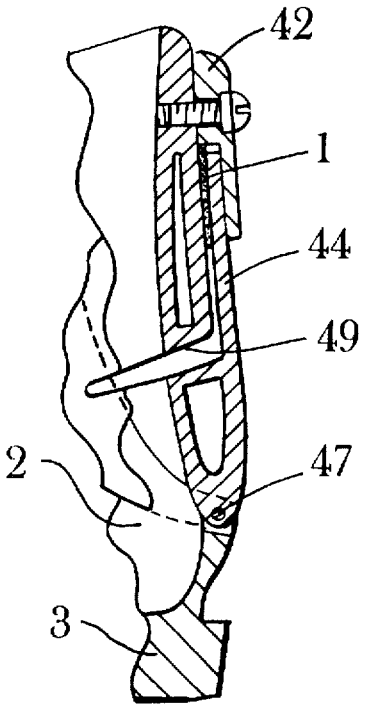

SHOE WITH CONTROLLED FLEXIBILITY

BACKGROUND OF THE INVENTION

1. Field of the Invention

The present invention relates to sport shoes, and notably ski boots with a shell that is at least partially rigid, including a shell base topped by an upper which is at least partially pivotal or flexible with respect to the shell base, and for which one wishes to control the pivoting or flexion with respect to the shell base with the help of a flexion control arrangement.

2. Description of Background and Relevant Information

In the majority of known alpine ski boots of the aforementioned type, the flexion control means are constituted by devices that are adapted to absorb, on a certain pivoting displacement amplitude of the upper, the biases induced by the supports of the lower portion of the skier's leg on this latter, either voluntary, or by reaction of the ski. These devices for controlling the flexion usually make use of elastically deformable means that, when they are released, restore sufficient energy to return the boot upper in its initial position. They thus ensure what is commonly called the "elastic return", i.e., the capacity of the boot to quickly return to its position and/or initial shape.

By way of example, U.S. Pat. No. 3,619,914 and French Patent Publication No. 2,557,776 can be cited as disclosing ski boots equipped with such flexion control devices positioned in the rear zone of the upper or in the front zone of the upper. These devices function directly between the shell base and at least one pivotal constituent portion of the upper. Elastic means, such as springs, oppose the frontward pivoting of the upper with respect to the shell base by compressing themselves, thereby storing energy. These elastic means have a progressive action that confers a variable flexibility to the boot upper during flexion for their resistance is especially greater as the upper is bent frontwardly. As a result, when the upper is in its initial position of rear support on the shell base, it can bend toward the front very easily and on a certain amplitude before it is perceived by the skier on the lower portion of his or her leg.

As a result, this absence of sensation of a good elastic retention at the beginning of flexion during the practice of skiing incites to skier to bend overly so that he constantly regains a perceptible and proper support on the upper. In such a movement, the skier unbalance himself toward the front, which then harm a good recuperation of its support toward the rear.

Furthermore, when the biases that provoked the flexion of the upper toward the front cease, the elastic means relax immediately while provoking the return of the shaft toward the rear in support on the shell base. Because no element disrupts or slows the relaxation speed of the elastic means, the latter restore the quasi totality of the energy that they have stored by compressing themselves, and produce a very quick elastic return. This behavior responds to the concern of rapidly returning the boot upper in rear support, but by accelerating the straightening of the upper and, therefore, of the lower part of the skier's leg, it provokes the unbalance of the skier toward the rear.

Other known means for controlling the flexion make use of elastically deformable means similar to those of the devices that have just been described and are associated with friction systems and/or means of intervening between the upper and the shell base.

French Patent Publication Nos. 2,564,710 and 2,256,734 teach such combinations. In the example of French Patent Publication 2,256,734, the portions of the upper and of the shell base that displace with respect to one another are nested and slide between them, and are connected by a flexion control device comprising an elastically deformable means. In such a construction, the nesting of the portions of the upper and of the shell base generate more or less substantial dry sliding friction that absorb a portion of the energy that causes the flexion of the upper, and a portion of the energy restored by the elastic means when the biases end.

In fact, the flexion control device is slowed in its functioning due to the sliding friction that moderates the elastic return and increase the flexional strength of the upper. Furthermore, at rest, a gluing effect is produced between the nested surfaces due in part to the difference in the coefficients of static and dynamic friction. Thus the weak biases that can occur between the lower part of the leg and the upper are largely absorbed due to this "gluing" effect that provide a certain advantage with respect to the means and/or devices of flexion control in which the action is simply progressive as in the preceding examples of U.S. Pat. No. 3,619,914 and French Patent Publication No. 2,557,776.

However, concerning a tight nesting between the sliding elements, the construction according to French Patent Publication No. 2,256,734 requires the formation of perfect joints between the elements to preserve an optimal sliding quality compatible with the constraints and pressures that they are subjected to. Also, the elements must be obtained in materials having very good mechanical characteristics so as to allow a minimum of wear, and therefore little variation in the frictions. Still, since the elements in movement are adapted to envelop the foot and/or the lower part of the leg, it is necessary to adjust them taking into account the specific, rather complex shapes, to give them, which enormously increases the manufacturing costs.

The example described in French Patent Publication No. 2,564,710 provides a fairly satisfactory solution to the disadvantages that have just been mentioned with respect to French Patent Publication No. 2,256,734. In effect, the construction described resolves the problems of controlling the adjustments and frictions between the moving elements and considerably reduces the costs. To this end, a joining and sliding element is adapted between the upper and the shell base taking into account the paths of the elements in movement and of their constituent material.

On the other hand, concerning the flexion control, the construction in question is not very satisfactory, for it simply proposes to vary progressively the pivoting stiffness of the upper by playing on the paths of the elements so that at least one is displaced along an engaging trajectory with respect to the other, and this, complementarily, or not with a specific elastic device for the flexion control. As a result of such a positioning, the opposition to the pivoting of the upper is therefore relatively weak at the outset, and it progressively intensifies as in the case of flexion control devices in U.S. Pat. No. 3,619,914 and French Patent Publication No. 2,557,776 that only utilize elastically deformable means. In effect, in the present construction, according to French Patent Publication No. 2,567,710, the upper of the boot can bend toward the front and on a certain amplitude without the biases being increased and, notably, without the skier perceiving them on the lower part of his or her leg. Furthermore, in the case where an elastic device is associated with the sliding element, the elastic return is, as previously, very quick and tends to create the unbalance of the skier when this latter returns in rear support after a substantial forward flexion.

Other ski boots are known in which the flexion control means is solely constituted by a braking device by dry friction. French Patent Publication No. 2,073,201 and European Patent Publication No. 135,184 describe such devices. The latter make use of friction elements that are interposed between the mobile portions of the upper and of the shell base and are adjustable in pressure so as to vary the frictional force, and thus, the flexional strength of the upper of the boot.

These devices have a functioning amplitude limited by abutment zones that determine the flexional amplitude of the upper with respect to the shell base. They allow the braking of the upper by always opposing, in principle, the same braking force regardless of the flexion position of the latter and its direction of flexion, toward the front or toward the rear. These devices thus give the upper of the boot a relatively constant flexibility, and therefore give the skier a perceptible retention sensation on the lower part of the leg by also absorbing the weak biases applied on the upper of the boot because of the relatively elevated resistance that they constantly oppose, even at the beginning of the flexion. Furthermore, they do not procure any elastic return of the upper after a forward flexion, and therefore they do not tend to unbalance the skier.

Such devices however have certain disadvantages due to the fact that they proceed by dry frictions occurring between elastically deformable means that are the friction elements and from the fact that they make use of a substantial number of elements that are adjustable between them to modify the contact pressure of the means. In effect, these elastic means do not avoid the "gluing effect" with the surfaces on which they rub and require precise adjustments with the portions of the upper and of the shell base between which they are interposed. In addition, such flexion control means produce disagreeable friction noises, such as grinding or squeaking, especially if the friction elements are made of metal or hard plastic.

SUMMARY OF THE INVENTION

An object of the present invention is to propose a resolution to the disadvantages of the preceding flexion control means with the help of an improved means for controlling the displacement of a movable element portion of the boot with respect to another element that procures a substantially constant silent braking between the elements relatively mobile between them, such an improved means being simple to use, easy to integrate in the general volume of the boot, and at a reduced manufacturing cost.

To this end, the sport boot according to the invention comprises a shell base topped by an upper that is at least partially pivotal or flexible, and for which the pivoting/flexion with respect to the shell base is subordinated to the action of at least one flexion control means, wherein this flexion control means is constituted by an element made of a viscous material that is interposed between the mobile portions of the boot and that overlap and relatively displace themselves, with respect to one another when the upper pivots, thus forming flexion control by viscous friction functioning in both to-and-fro directions of the flexion of the upper.

Such a viscous material produces a braking of the flexion movement of the upper that is perceptible on the lower part of the skier's leg from the beginning of the movement, regardless of the bent position of the upper and the direction of the flexion. In fact, the braking-absorbing is variable as a function of the speed of the biases, i.e., the more rapid the biases, the stronger the braking, and the vice-versa. In addition, an increased seal is obtained between the upper and the shell base while avoiding a precise adjustment of the mobile portions between them.

The element of viscous material is preferably interposed between the walls of the upper and the shell base in a zone where their overlapping is permanent regardless of the flexion amplitude of the upper during skiing, and also in a zone that does not open toward the exterior, in particular where the tightening systems and adjustment systems of the upper and/or the shell base are positioned on the lower part of the leg and the foot of the skier.

Thus the element of viscous material can be positioned in the heel zone, in one and/or lateral zone(s) of the boot, or in the front zone of the boot corresponding with the top of the foot and/or the front of the lower part of the skier's leg.

The element of viscous material, of a sticky consistency, thus interposed between the mobile portions of the upper and of the shell base that overlap, constitutes a flexible joint that adapts easily and perfectly to the contiguous surfaces between which it extends, thereby ensuring the seal, since its viscosity enables it to be obtained under a shallow thickness, it is easy to place it in a very simplified and non-voluminous structure, for example a shallow recess, and therefore to integrate it easily in the general volume of the boot. Positioned between the two mobile portions, the viscous element ensures a practically silent sliding friction while opposing a certain resistance since the mobile portions tend to spread it further each time they are displaced. According to its degree of viscosity and/or its surface that is brought into use, the viscous element opposes more or less resistance to the internal flow or friction. Thus, according to the choice made, one can provide a more or less substantial braking or shock absorbing that, in all cases, has the advantage of functioning in the two displacement directions of the mobile portions of the upper and the shell base, and with a substantially constant resistance.

Yet, due to its consistency, the viscous element more or less adheres to the contiguous surfaces and has the advantage of opposing an elevated resistance before permitting the sliding during a shock or brief and intense bias. Thus, the viscous element likewise permits the absorption of the biases or brief shocks that are of low intensity and that intervene between the upper and the shell base, both in frontward flexion and rearward flexion.

According to an embodiment, the flexion control means constituted by the viscous element is associated with an elastic flexion control device, possibly adjustable in amplitude and force, and adapted to ensure the elastic return of the boot upper in support toward the rear on the shell base. The viscous element thus makes it possible to alleviate the elastic returns that are too quick and suppresses the sensations of play and/or of softness at the beginning of flexion.

In another embodiment, the viscous element is positioned in a hollow element, such as a sheath, that belongs to one of the mobile portions and another element, such as a plunger, is fixed at one end to the other of the mobile portions, and slidably engages in the hollow element by its other end that plunges into the viscous element.

Preferably, the plunger is provided to be flexible so that when the boot upper pivots frontwardly, it opposes thereto an elastic return that is supplemental to the viscous friction.

In such construction example, the plunger plays the role of an elastic flexion control means. It particularly ensures the elastic return of the upper in support toward the rear on the shell base, while being slowed down by the viscous element. The elastic return, thus dampen, does not tend to unbalance the skier.

According to a variation, the viscous element is interposed between two elements, immobilized on one of the relatively mobile portions of the upper and/or shell base, and a member fixed on the other mobile portion and that passes between the elements. These latter are adapted to be slidably releasable. Thus, when they remain fixed, the viscous element is biased on all contiguous surfaces. On the contrary, when one or both elements are free to slide, the viscous material no longer works but with respect to the surface of one of the two sliding elements or none thereof. This arrangement therefore enables the viscous friction value to vary by selection of the biased surfaces of the viscous element.

The material constituting the viscous element can be of any type and, for example, have a viscosity at 40° C. comprised between 20 and 1,500 poises. Preferably the viscosity is of about 400 poises. The material can likewise by of organic or mineral oil.

BRIEF DESCRIPTION OF THE DRAWINGS

Other characteristics and advantages of the invention will be better understood upon reading the description that follows and with reference to the annexed drawings giving, by way of example, several embodiments applied to a ski boot.

FIGS. 3 and 4 illustrate another ski boot comprising an elastic flexion control device associated with a flexion control means of the viscous type, FIG. 3 showing the boot in longitudinal cross section, and FIG. 4 showing the boot in front perspective;

FIGS. 5 and 6 represent a ski boot with an upper that is latchable on the shell base provided with an elastic flexion control device cooperating with the a flexion control means of the viscous type;

FIG. 7 illustrates a varying embodiment of the upper of the boot of FIGS. 5 and 6.

DETAILED DESCRIPTION OF THE PREFERRED EMBODIMENTS

Figure 1:
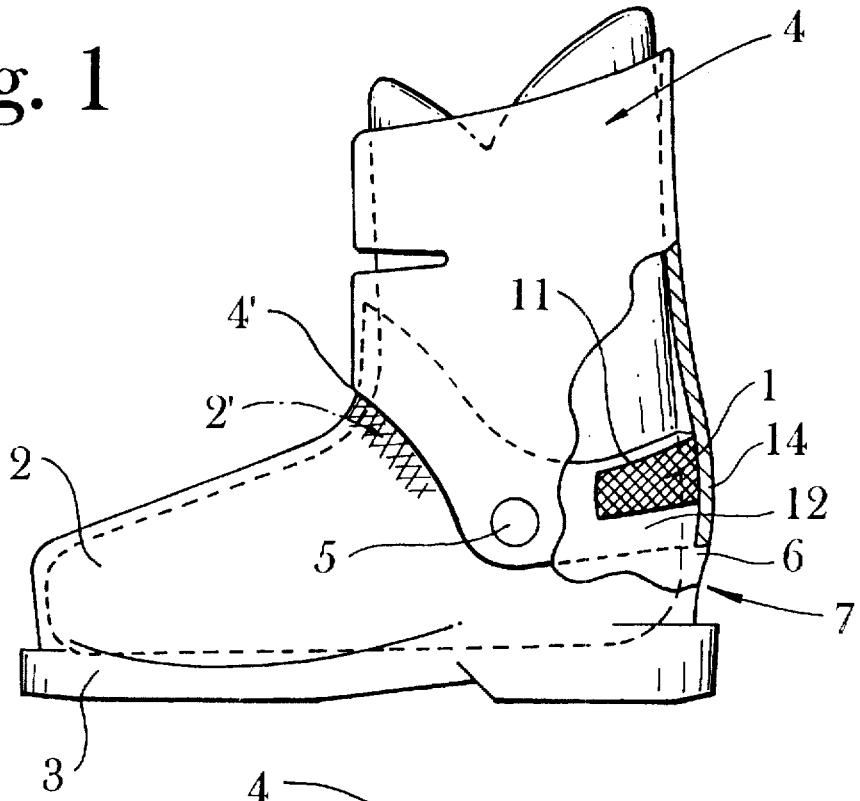
FIGS. 1 and 2 show, in partially cutaway elevational and cross-sectional views, two alpine ski boots provided with the flexion control means of the viscous type according to the invention.

The ski boots illustrated in FIGS. 1–11 are provided with a flexion control means of the viscous friction type, such as a viscous element 1, and having, in a manner known in itself, a shell base 2 provided with a sole 3, and an upper 4, in one or several portions, that is at least partially pivotal about an axis 5 with respect to the shell base 2. The pivoting can likewise be obtained by elastic deformation of the upper about a weakened zone serving as a journal, as will be described with reference to FIGS. 5–7. These ski boots, referred to as boots with a shell, are made of plastic materials and likewise comprise at least one elastic flexion control means of a known type that is adapted to absorb the biases induced by the support of the lower part of the skier's leg (not shown) on their upper 4, which elastic means determines what is commonly called the stiffness.

In the case of FIG. 1, the elastic flexion control means is constituted, in fact, by the inherent flexibility of the shell base 2 and of the upper 4 in the zone of their front overlapping. In effect, the lower front edge 4' of the upper 4 is supported on the curved portion 2' of the shell base 2, substantially in correspondence with the flexion fold, and the upper 4 is pivoting on its axis 5 in the malleoli zone. As a result, any frontward flexion provokes a more or less substantial engagement of the lower edge 4' on the portion 2', according to a circular trajectory centered on axis 5, which slide on each other and deform elastically as long as the biases last. Upon release, the curved portion 2' and the lower edge 4' slacken and return approximately to their initial position provoking the straightening of the upper 4 in rearward support on an abutment 6 of the shell base 2.

The ski boot represented having a front opening, the viscous element 1 of the flexion control means is arranged in the heel zone 7 and is interposed between the walls 14 and 12 of the upper 4 and the shell base 2, respectively. These walls 14 and 12 permanently overlap and displace relative to each other when the upper 4 pivots with respect to the shell base 2, and reciprocally. These walls 14 and 12 thus constitute the relatively mobile portions that are in contact with the viscous element 1 and that are slowed down in translation by the latter outside of their relative movement. This latter being biased to stretch out in the direction of the movement during front and rear flexions of the upper 4, a shallow housing 11 is preferably obtained in one of the walls 12 or 14.

Figure 2:
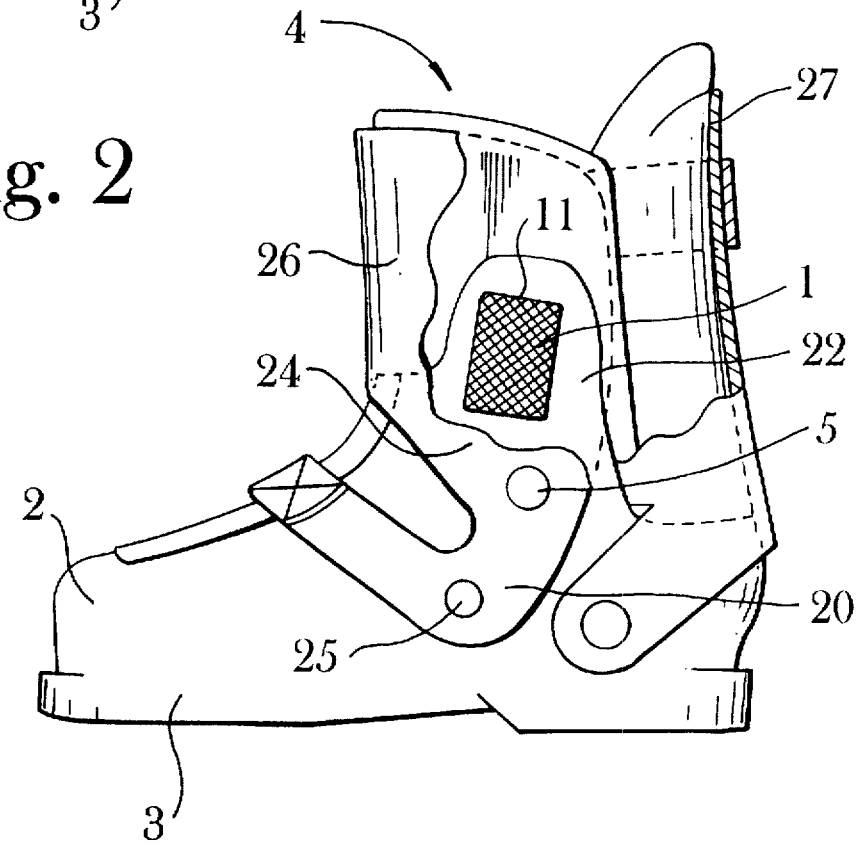
Figure 8:
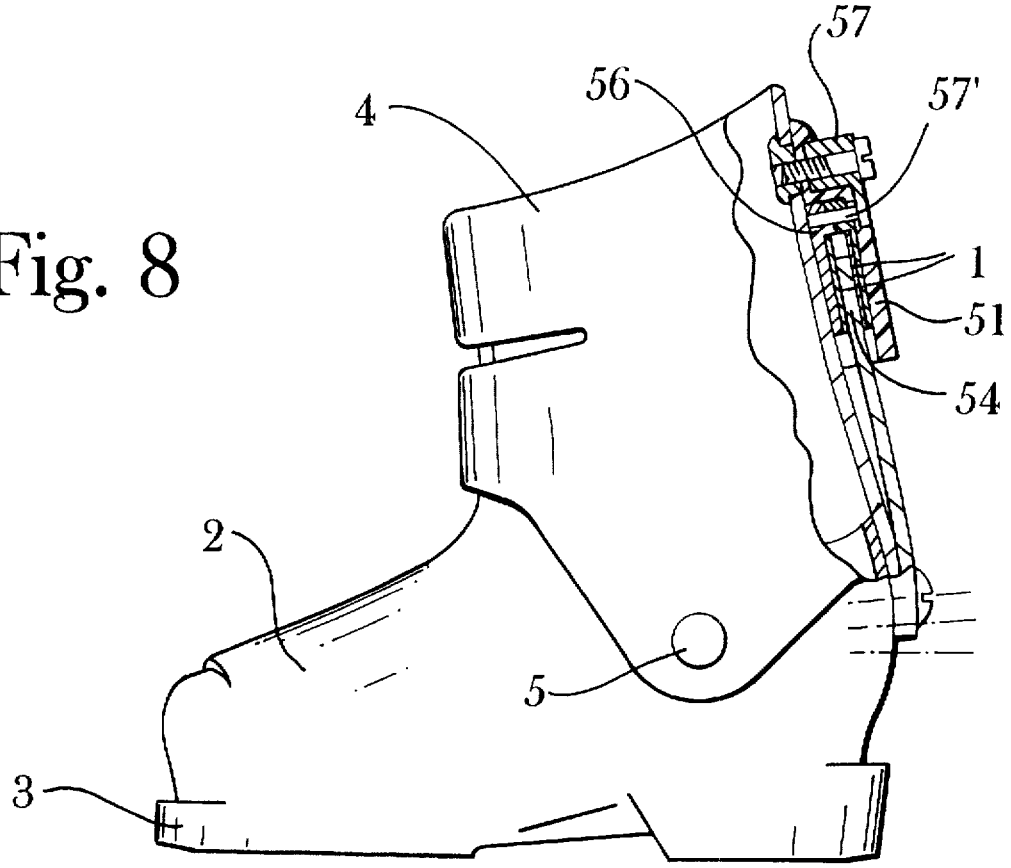
FIGS. 8, 9, 10, and 11 represent another mode of implementing the flexion control means of the viscous type and different adjustments of its frictions by selection of the biased surfaces.

In FIG. 2, the boot has a rear and/or center opening, and its upper 4 has a rear opening spoiler 27 and a cuff 26 held in position on the shell base 2 by means of an elastic flexion control means. This elastic means is constituted by a flexible flap 20 anchored on the shell base 2 on axis 5 and on a rivet 25. As previously, this elastic flexion control means opposes a flexional elastic resistance toward the front and provides an elastic return upon release. The rear spoiler 27 widely opening the back portion of the upper 4 and of the shell base 2, the viscous element 1 is then arranged on at least one of the sides of the boot, between the walls 24 and 22 of the cuff 26 of the upper 4 and of the shell base 2 respectively. Thus, during flexions of the upper 4, the viscous element 1 remains caught between the walls 24 and 22 that are the mobile portions in contact with the viscous element 1. As previously, the viscous element 1 is preferably placed in a housing 11.

In FIGS. 3 and 4, the boot also has a rearward opening, but, in this type of construction, the front spoiler 36, or cuff, is maintained in position on the shell base 2 by means of an elastic flexion control device 30. This elastic device 30 comprises a more or less flexible bar 31 and a runner 33, adjustable in position on the bar 33, which serves as a support abutment for the lower anterior edge of the cuff 36. This device is capable of elastically bending when the cuff 36 is pivotally biased toward the front and of returning the cuff 36 toward the rear in its initial position when the biases cease. So as to absorb the too quick functioning of such a device, a flexion control means of the viscous friction type is used on the upper anterior portion of the shell base 2, and that opposite the upper 4. To this end, the cuff 36 is provided with a tongue 34 that, by its free end, slides in a hollow element or sheath 32 fixed on the shell base 2 and more or less filled by the viscous element 1. The portions relatively mobile between them are, in this case, constituted by the tongue 34 and the sheath 32 that can be obtained in one piece in the walls of the cuff 36 and of the shell base 2 or attached thereto.

The boot in FIGS. 5 and 6 comprises an upper 4 that is latchable on the shell base 2 by means of an elastic nesting system, tenon 40-slot 41, provided between the upper 4 and wings 46 extending from the shell base 2. The upper 4 can be opened on the front and is journalled on a axis 47 in the heel zone of the shell base 2. A lateral abutment 48, fixed on the sides of the shell base 2, blocks the upper 4 toward the front during its closing on the lower part of the skier's leg in the position of the practice of skiing.

A flexion slit 49, transversely extending in the dorsal zone of the boot substantially between the elastic nesting system 40-41 and the abutment 48, is provided to allow the upper 4 to bend forward by elastic deformation of the material bridge 45 existing between the system 40-41 and the abutment 48, and approximately about fictitious axis 5. This structure constitutes, in fact, the flexion means and the elastic flexion control means of the upper with respect to the shell base.

A tongue 44, fixed on the shell base 2, on journal axis 47, for example, extends vertically on the dorsal zone of the upper 4 and slidably engages by its free end in a hollow element 42 affixed to the upper 4. As in the example of FIGS. 3 and 4, this hollow element 42 is more or less filled by the viscous element 1. The mobile portions are, in this construction, constituted by the tongue 44 and the hollow element 42.

According to a varying embodiment, the tongue 44 can be obtained in one piece with the upper 4 as represented in FIG. 7, the functioning remaining identical.

The tongue 44 can possibly be provided to be more of less flexible so as to also participate in the flexion control simultaneously with its action on the viscous element 1 for damping the movements.

Figure 9:
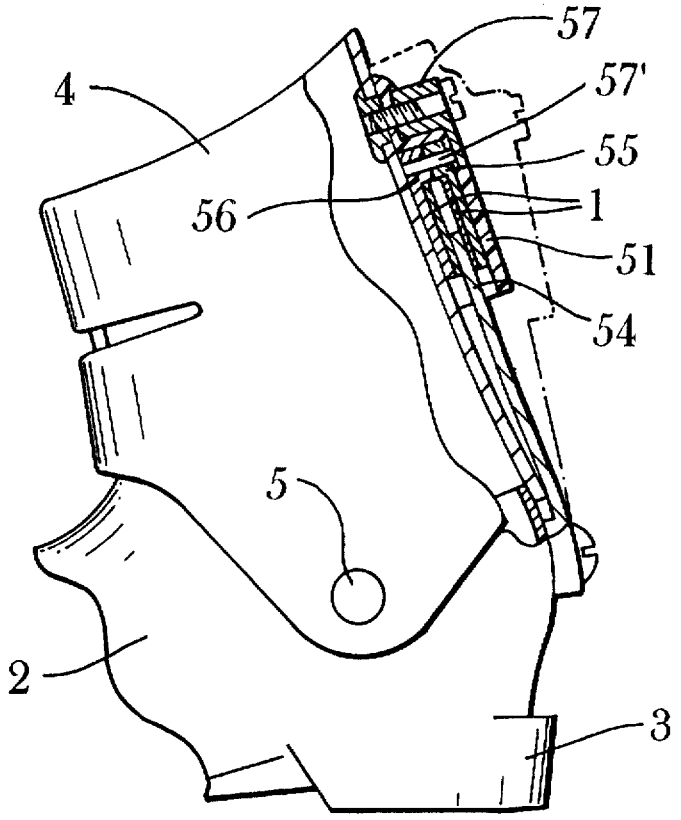
Figure 10:
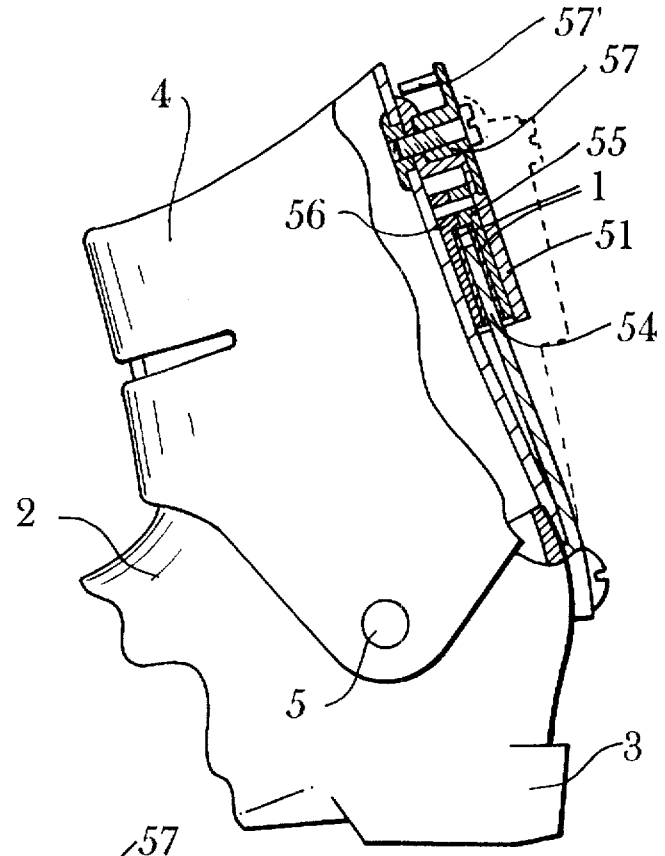

The ski boot illustrated in FIGS. 8–11 has a front opening, and its upper 4 is dampen in its flexional movements about its axis 5 by means of a viscous element 1 interposed between a tongue 54 and two elements 55 and 56 between which the latter is free to slide, the whole being situated in a sheath 51 fixed on the upper 4. The portions relatively mobile between them are, in this case, the elements 55–56 and the tongue 54. A reversal element 57 provided with a spur 57' can be positioned on the sheath 51, in one case, FIGS. 8 and 9, coming into engagement by means of its spur 57' in corresponding holes obtained in the elements 55 and 56, and in the other case, FIG. 10, by reversing at 180° while releasing elements 55 and 56 from its spur 57'. Thus, when the spur 57' is in engagement in the elements 55 and 56, the forward flexion of the upper forces the tongue 54 to slide by friction over the entire surface occupied by the viscous element 1 as illustrated in FIG. 9. Inversely, when the elements 55 and 56 are no longer blocked with respect to the sheath 57, FIG. 10, the frontward flexion of the upper 4 simply provokes the free sliding of the elements 55 and 56 in the sheath 51 without the tongue 54 rubbing on the viscous element 1. In this adjustment example, the flexion control means by viscous friction is thus neutralized.

In these examples of FIGS. 6–11, the flexion control means 1 with viscous friction is arranged in the upper dorsal zone of the upper 4, the tongues 44 and 54 having their free ends directed upward. It is evident that this control means 1 can be adapted to the lower dorsal zone of the upper 4 and, in this case, the tongues 44 and 54 come through their free ends to plunge downward in the sheaths 42 and 51. The viscous element 1 is thus likewise maintained in position by its own weight.

Figure 11:
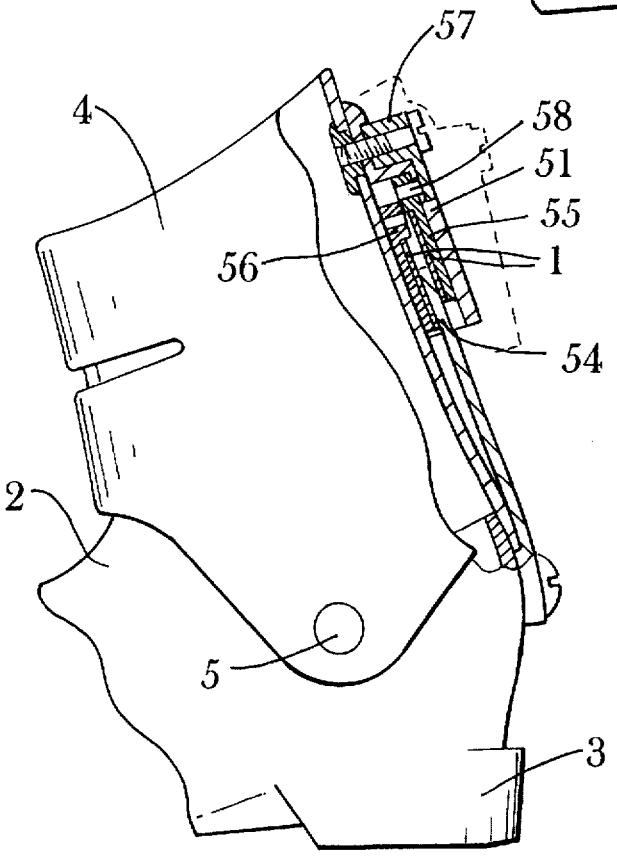

According to an improvement, such as is visible in FIG. 11, the reversal element 57 can be provided with a spur 58 shorter than that of 57', so that in the engagement position, it only blocks one 55 of the gliding portions. When the upper 4 bends forward, the tongue 54 only rubs on the portion 55 blocked by the spur 58.

The application of the viscous element is not limited to a ski boot, but extends to any sport boot comprising a shell base that is at least partially rigid and an upper that is likewise at least partially rigid and notably comprising a rigid collar being able to pivot or bend with respect to the shell base, and in which one wishes to slow the front and rear flexion/pivoting movement of the upper with respect to the shell base, for example, cross-country ski boots, skates, ice skates, surfing, etc.

The instant application is based upon French Patent Application No. 95.01699, filed on Feb. 10, 1995, the disclosure of which is hereby expressly incorporated by reference thereto in its entirety and the priority of which is claimed under 35 USC 119.

Although the invention has been described with reference to particular means, materials, and embodiments, it is to be understood that the invention is not limited to the particulars expressly disclosed, but the invention extends to all equivalents within the scope of the claims that follow.

What is claimed is:

1. A sports shoe comprising:

a shell base;

an upper extending upwardly from said shell base, said upper being movably affixed to said shell base, said upper and said base comprising respective overlapping portions, each of said respective overlapping portions being movable with respect to the other during movement of said upper with respect to said shell base;

at least one movement control arrangement to control movement of said upper with respect to said shell base; and a viscous control device including a viscous material interposed between and in contact with said respective overlapping portions of said upper and said shell base, said viscous material having a viscosity at 40° C. of between 20 and 1,500 poise.

2. A sports shoe according to claim 1, wherein:

a flexible connection connects said upper and said shell base, whereby said upper is adapted to flex with respect to said shell base.

3. A sports shoe according to claim 1, wherein:

a pivot connection connects said upper and said shell base, whereby said upper is adapted to pivot with respect to said shell base.

4. A sports shoe according to claim 1, wherein:

said overlapping portions are constituted by a wall of said upper and a wall of said shell base, said walls being in constant overlapping relationship with said viscous material interposed between said walls.

5. A sports shoe according to claim 4, wherein:

said movement control device comprises an elastic movement control device;

said wall of said upper comprises a lower front edge of said upper; and said wall of said shell base comprises a curved portion substantially corresponding to a flexion fold area of a foot of a wearer, at least said curved portion of said shell base being made of a plastic material, whereby said lower front edge of said upper and said curved portion of said shell base constitute said elastic movement control device, whereby forward movement of said upper causes deformation of said curved portion of said shell base.

6. A sports shoe according to claim 1, wherein:

said overlapping portions are constituted by an element affixed to said upper and an element affixed to said shell base, said elements being in a slidable contacting relationship with said viscous material interposed between said elements.

7. A sports shoe according to claim 4, wherein:

said viscous control device includes a shallow housing in one of said walls; and said viscous material is located within said shallow housing.

8. A sports shoe according to claim 6, wherein:

said viscous control device includes a shallow housing in one of said elements; and said viscous material is located within said shallow housing.

9. A sports shoe according to claim 6, wherein:

one of said elements comprises a hollow member, said hollow member being affixed to one of said upper and said shell base;

a second of said elements comprises a projecting member projecting into said hollow member, said projecting member being affixed to the other of said upper and said shell base; and said viscous material being located within said hollow member.

10. A sports shoe according to claim 9, wherein:

said hollow member and said projecting member are affixed to rear portions of the shoe.

11. A sports shoe according to claim 9, wherein:

said projecting member is flexible and comprises an elastic control device by opposing forward movement of said upper with respect to said shell base and by ensuring elastic rearward return movement of said upper; and said viscous control device comprises a means for dampening said forward and rearward movement of said upper with viscous friction generated by said viscous material.

12. A sports shoe according to claim 1, wherein:

said viscous control device, including said viscous material, is located on at least one side of the shoe between said upper and said shell base.

13. A sports shoe according to claim 1, wherein:

said viscous control device, including said viscous material, is located at an anterior portion of the shoe, said anterior portion of the shoe corresponding to a top of a wearer's foot and a lower portion of the wearer's leg.

14. A sports shoe according to claim 1, further comprising said viscous control device comprising means for exerting a braking force on said movement of said upper with respect to said shell base as a function of a speed of forces exerted at said viscous material:

means for varying a magnitude of said braking force exerted by said viscous control device.

15. A sports shoe according to claim 14, wherein:

said means for varying a magnitude of said braking force comprises a releasable latching device for selectively latching and unlatching one of said overlapping portions with respect to a second of said overlapping portions, whereby in an unlatched position, said braking force exerted by said viscous material is reduced with respect to said braking force in said latched position.

16. A sports shoe comprising:

a shell base;

an upper extending upwardly from said shell base, said upper being movably affixed to said shell base, said upper and said base comprising respective overlapping portions, each of said respective overlapping portions being movable with respect to the other during movement of said upper with respect to said shell base;

at least one elastic control arrangement controlling movement of said upper with respect to said shell base; and a viscous material interposed between and in contact with said respective overlapping portions of said upper and said shell base, said viscous material having a viscosity at 40° C. of between 20 and 1,500 poise.

17. A sports shoe according to claim 16, wherein:

said viscosity at 40° C. is about 400 poise.

18. A sports shoe according to claim 16, wherein:

the sports shoe comprises a ski boot.

19. A sports shoe according to claim 1, wherein:

said viscous material comprises organic or mineral oil.

* * * * *